US006761162B1

(12) United States Patent
Swann

(10) Patent No.: US 6,761,162 B1
(45) Date of Patent: Jul. 13, 2004

(54) PERSONAL DISPOSABLE EMERGENCY BREATHING SYSTEM WITH RADIAL FLOW

(75) Inventor: Linsey J. Swann, Vancouver (CA)

(73) Assignee: Brookdale International Systems, Inc. (CA)

( * ) Notice: Subject to any disclaimer, the term of this patent is extended or adjusted under 35 U.S.C. 154(b) by 0 days.

(21) Appl. No.: 10/326,625

(22) Filed: Dec. 23, 2002

(51) Int. Cl.[7] ..... A62B 7/10

(52) U.S. Cl. ..... 128/201.25; 128/205.12; 128/205.27

(58) Field of Search ..... 128/201.25, 205.12, 128/205.27; 55/DIG. 33, DIG. 35

(56) References Cited

U.S. PATENT DOCUMENTS

| | | | | | |
|---|---|---|---|---|---|
| 492,980 | A | * | 3/1893 | Coquy | 128/201.25 |
| 703,948 | A | * | 7/1902 | Muntz | 128/201.25 |
| 807,666 | A | * | 12/1905 | Drager | 128/201.25 |
| 1,298,404 | A | * | 3/1919 | Romanoff | 128/205.27 |
| 1,474,205 | A | * | 11/1923 | Mase | 128/204.15 |
| 1,501,286 | A | * | 7/1924 | Logan | 96/136 |
| 1,585,113 | A | * | 5/1926 | Robert | 96/136 |
| 1,889,015 | A | * | 11/1932 | Davis | 128/205.28 |
| 1,929,343 | A | * | 10/1933 | Belloni | 128/201.25 |
| 1,931,989 | A | * | 10/1933 | Jenness | 422/122 |
| 2,048,059 | A | * | 7/1936 | Giraudet DeBoudemanage | 128/201.25 |
| 2,174,528 | A | * | 10/1939 | Prentiss | 55/498 |
| 3,140,590 | A | * | 7/1964 | Gleuckler | 62/259.3 |
| 3,277,890 | A | * | 10/1966 | Warncke | 128/205.12 |
| 3,338,238 | A | * | 8/1967 | Warneck | 128/205.12 |
| 3,525,334 | A | * | 8/1970 | Braman | 128/201.25 |
| 3,565,068 | A | * | 2/1971 | Bickford | 128/201.25 |
| 3,731,678 | A | * | 5/1973 | Pyzel | 128/202.26 |
| 3,736,927 | A | * | 6/1973 | Misaqi | 128/201.25 |
| 3,976,063 | A | * | 8/1976 | Henneman et al. | 128/201.25 |
| 4,154,235 | A | * | 5/1979 | Warncke | 128/201.25 |
| 4,277,443 | A | * | 7/1981 | Van der Smissen et al. | 422/122 |
| 4,350,507 | A | * | 9/1982 | Greenough et al. | 73/863.23 |
| 4,467,795 | A | * | 8/1984 | Eckstein | 128/201.25 |
| 4,552,140 | A | * | 11/1985 | Cowley et al. | 128/201.25 |
| 4,572,178 | A | * | 2/1986 | Takase et al. | 128/205.27 |
| 4,614,186 | A | * | 9/1986 | John | 128/201.25 |
| 4,764,346 | A | * | 8/1988 | Lewis et al. | 422/120 |
| 5,003,974 | A | * | 4/1991 | Mou | 128/201.25 |
| 5,036,844 | A | * | 8/1991 | Pouchot et al. | 128/206.17 |
| 5,038,768 | A | * | 8/1991 | McGoff et al. | 128/202.26 |
| 5,113,527 | A | | 5/1992 | Robertson-McKenzie | 2/7 |
| 5,186,165 | A | * | 2/1993 | Swann | 128/201.28 |
| 5,222,479 | A | * | 6/1993 | Brauer et al. | 128/202.26 |
| 5,315,987 | A | * | 5/1994 | Swann | 128/201.28 |
| 5,394,867 | A | * | 3/1995 | Swann | 128/201.25 |
| 5,524,616 | A | * | 6/1996 | Smith et al. | 128/205.27 |
| 5,526,804 | A | * | 6/1996 | Ottestad | 128/201.25 |
| 5,640,952 | A | * | 6/1997 | Swann et al. | 128/206.17 |
| 5,848,592 | A | * | 12/1998 | Sibley | 128/205.27 |
| 5,964,218 | A | * | 10/1999 | Smith et al. | 128/201.25 |
| 5,964,221 | A | * | 10/1999 | McKenna | 128/205.12 |
| 5,996,580 | A | * | 12/1999 | Swann | 128/206.17 |
| 6,041,778 | A | * | 3/2000 | Swann et al. | 128/201.25 |

* cited by examiner

*Primary Examiner*—Aaron J. Lewis
(74) *Attorney, Agent, or Firm*—Nixon & Vanderhye P.C.

(57) ABSTRACT

The breathing system includes an annular filtration unit having apertures opening radially through inner and outer walls thereof, a central passageway and filtration material between the walls. The filtration unit is disposed in a canister containing a hood, a mouthpiece, a closure and an annular filter in the annular space between the filtration unit and the wall of the canister. Upon removal of the closure, the hood and mouthpieces are deployed and the hood is drawn about an individual's head through an opening in the hood. With the mouthpiece in the individual's mouth, ambient air from a toxic gas or smoke-filled environment is drawn into the canister through the annular filter, and passes radially inwardly through the filtration unit into the central passageway, where the filtered air reverses direction for flow axially into the mouthpiece such that the individual may breathe filtered air. Exhaled air passes into the hood and out through the hood opening.

19 Claims, 5 Drawing Sheets

PERSONAL DISPOSABLE EMERGENCY BREATHING SYSTEM WITH RADIAL FLOW

BACKGROUND OF THE INVENTION

The present invention relates to a compact, self-contained, low-cost, integrated, disposable and personal emergency breathing system for breathing filtered air in toxic gas or smoke-filled environments.

Personal breathing systems for use in emergency situations, for example, in toxic gas or smoke-filled environments, have been designed and constructed in the past. For example, in each of my prior U.S. Pat. Nos. 5,186,165 and 5,315,987, the disclosures of which are incorporated by reference, there is provided a canister containing a filtration unit, a hood, and a mouthpiece, the canister also including a closure for containing the hood, mouthpiece and filtration unit within the canister in an unused but ready-for-use condition. Upon removal of the closure and deployment of the mouthpiece and hood from the canister, the individual may don the hood by pulling the hood over the individual's head and locate the deployed mouthpiece in his/her mouth. The canister remains attached to the mouthpiece and hood and is supported by the individual by the mouthpiece. By breathing filtered air, the individual may escape from the toxic gas or smoke-filled environment.

In one form, a tab is removable from the bottom of the canister to expose apertures to ambient air whereby ambient air is supplied to the filtration unit and filtered air is provided to the individual for breathing through the mouthpiece. In another form, the removal of the closure not only permits deployment of the hood and mouthpiece but also exposes an inlet into the canister so that ambient but toxic gas or smoke-filled air is passed axially through the filtration unit so that the individual can breathe filtered air. Canisters of this type have been eminently successful and have enabled individuals to escape environments filled with smoke or toxic gases.

BRIEF DESCRIPTION OF THE INVENTION

In accordance with a preferred embodiment of the present invention, there is provided a similar type of personal compact breathing system, including a canister containing a filtration unit, a hood and a mouthpiece wherein the filtration unit is specifically configured to have an increased mass of filtration material and a reduced pressure drop. As in the prior systems, the hood and mouthpiece are deployable from the canister upon removal of the closure. In accordance with an aspect of the present invention, however, the filtration unit is provided in an annular configuration. The annular filtration unit defines with the interior walls of the canister an annular passage about the filtration unit. The inner and outer walls of the filtration unit have apertures for passing ambient air received within the annular passage about the filtration unit in a direction generally radially inwardly of and through the filtration unit. The filtration unit also includes a central passageway for directing the filtered breathable air axially away from the filtration unit and into the mouthpiece.

Additionally, the annular passage about the filtration unit includes an annular filter in communication with an air inlet into the canister. Particularly, and in a preferred embodiment, the air inlet is exposed to receive ambient air upon removal of the closure. The filter in the annular passage is closed at one end and open at its opposite end to receive the ambient air from the air inlet whereby air passes through the filter for passage radially inwardly through the filtration unit and into the central passageway. The filtration unit also includes interior linings along the inner and outer walls to confine the particulate material of the filter and any fines of, for example, activated charcoal, within the annular unit.

The end of the filtration unit adjacent the lower end of the canister includes a cap and annular resilient material along an inside surface of the cap facing and in registration with the particulate material in the filtration unit. The resilient material maintains the particulate material in a compacted or compressed condition within the filtration unit, avoiding settling. Also, an annular rib or rim is carried by the end cap as well as by an annular ring of the opposite end of the filtration unit to preclude channeling or air bypass about the filtration material.

In a further embodiment of the present invention, a monolith filter is provided for converting carbon monoxide to carbon dioxide by a catalyzation process. The monolith filter overlies the upper annular end of the filtration unit and defines an annular plenum therewith. The tube defining the central passage terminates below the monolith filter and above the end of the annular filtration unit to define an annular plenum. As a consequence, filtered air from the first filter passes through the disk-like monolith filter from the plenum and from the central tube. The monolith filter is a ceramic substrate dipped in precious metals, such as palladium or platinum.

In a preferred embodiment according to the present invention, there is provided a personal emergency breathing system comprising a canister having an opening and a closure removably carried by the canister for closing the opening, a generally annular air filtration unit within the canister containing air filtering material and defining with the canister an annular passage about the filtration unit for receiving ambient air from an air inlet to the canister, the filtration unit having an axially extending central passageway and inner and outer walls with apertures enabling transmission of ambient air in a generally radial direction from the annular passageway through the walls and filtering material and into the central passageway, a mouthpiece carried by the canister in communication with the central passageway for receiving filtered air from the central passageway and deployable from the canister, a hood carried by the canister enveloping the mouthpiece and deployable from the canister, the hood having an opening for receiving an individual's head and neck whereby the hood, when deployed from the canister, may envelop an individual's head, the mouthpiece and the hood being disposed in a collapsed condition in the canister adjacent the canister opening and between the filtration unit and the closure whereby, upon removal of the closure from the opening, the hood and the mouthpiece are deployable from the canister through the canister opening to a location external to the canister, with the mouthpiece in communication with and receiving filtered air from the filtration unit.

In a further preferred embodiment according to the present invention, there is provided a personal emergency breathing system comprising a canister having an opening and a closure removably carried by the canister for closing the opening, a generally annular air filtration unit within the canister containing air filtering material and defining with the canister an annular passage about the filtration unit for receiving ambient air from an air inlet to the canister, the filtration unit having an axially extending central passageway and inner and outer walls with apertures enabling transmission of ambient air in a generally radial direction from the annular passageway through the walls and filtering material and into the central passageway, a plenum in the canister for receiving the filtered air from the central passageway, a secondary filter for receiving the filtered air from the plenum and further filtering the air, a mouthpiece carried by the canister in communication with the secondary passageway for receiving the further filtered air and deployable from the canister, a hood carried by the canister enveloping the mouthpiece and deployable from the canister, the hood having an opening for receiving an individual's head and neck whereby the hood, when deployed from the canister, may envelop an individual's head, the mouthpiece and the hood being disposed in a collapsed condition in the canister adjacent the canister opening and between the filtration unit and the closure whereby, upon removal of the closure from the opening, the hood and the mouthpiece are deployable from the canister through the canister opening to a location external to the canister, with the mouthpiece in communication with and receiving the further filtered air.

DETAILED DESCRIPTION OF THE INVENTION

Figure 1:
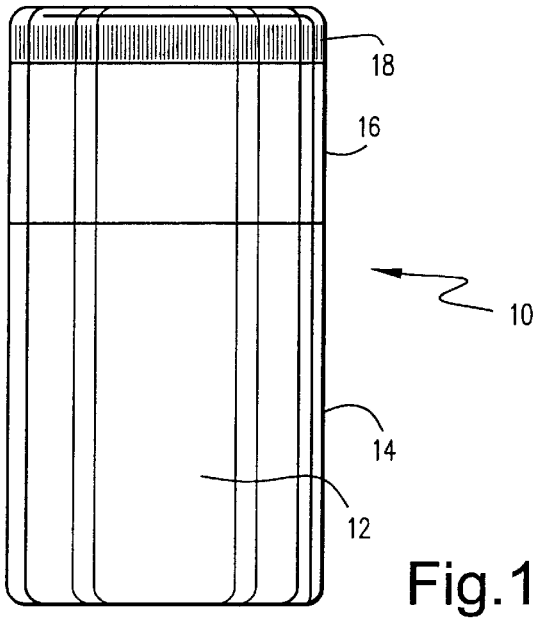
FIG. 1 is a side elevational view of a personal disposable emergency breathing system according to a preferred embodiment of the present invention and illustrates a canister containing various elements of the system prior to use.

Referring now to the drawings, particularly to FIG. 1, there is illustrated a personal disposable emergency breathing system, generally designated 10, constructed in accordance with the present invention. The breathing system 10, as illustrated in FIG. 1, is in a stored condition prior to use. The system 10 includes a canister 12 having a canister body 14, an intermediate ring 16 and a closure 18. As in my prior patents noted above, the canister is preferably formed of a flame-retardant plastic material such as PC and is preferably closed at its lower end.

Figure 2:
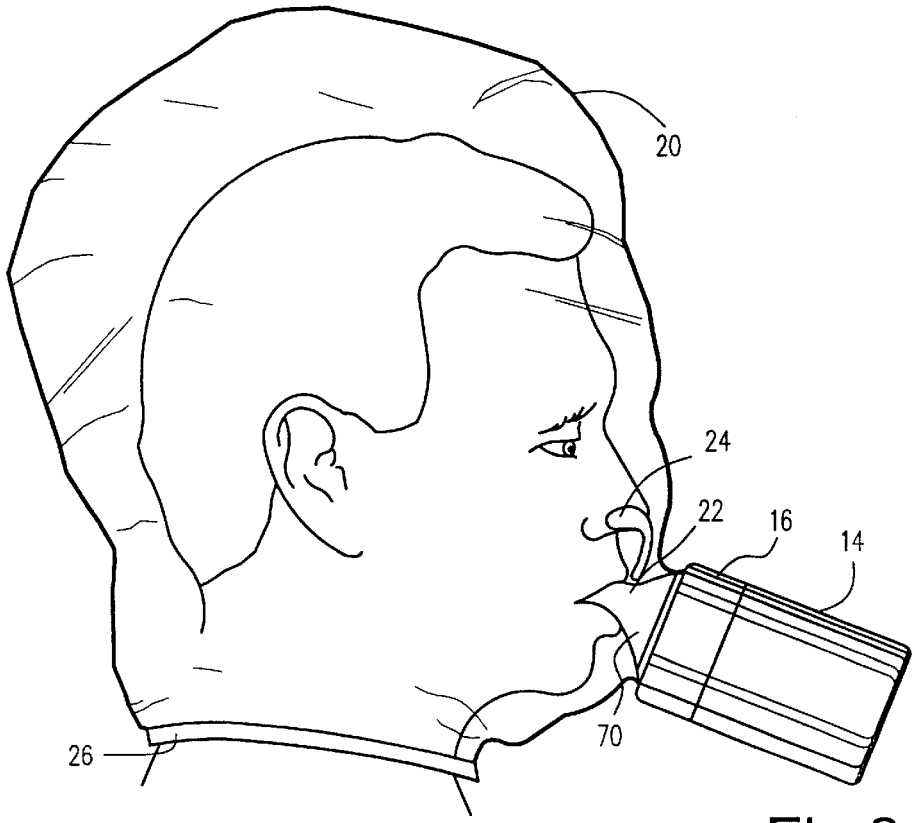
FIG. 2 is a schematic side elevational view of the breathing system hereof in use by an individual.

The breathing system 10 is illustrated in use in FIG. 2. Particularly, the canister body 14 contains a hood 20 and a mouthpiece 22 which, upon removal of closure 18, are deployed from the canister, as illustrated. The mouthpiece 22 also includes nose clips 24. The hood 20 includes an opening bounded by a closing means, e.g., a drawstring, drawtape, elastic or rubber seal 26 by which the individual can don the hood over his head with the drawstring 26 forming a loose collar about the individual's neck, permitting air exhaled into the hood to egress from the hood. The hood 20 is preferably transparent and is preferably constructed of Kapton® and preferably includes a titanium coating, for example, as described and illustrated in U.S. Pat. No. 5,113,527, incorporated herein by reference.

Figure 3:
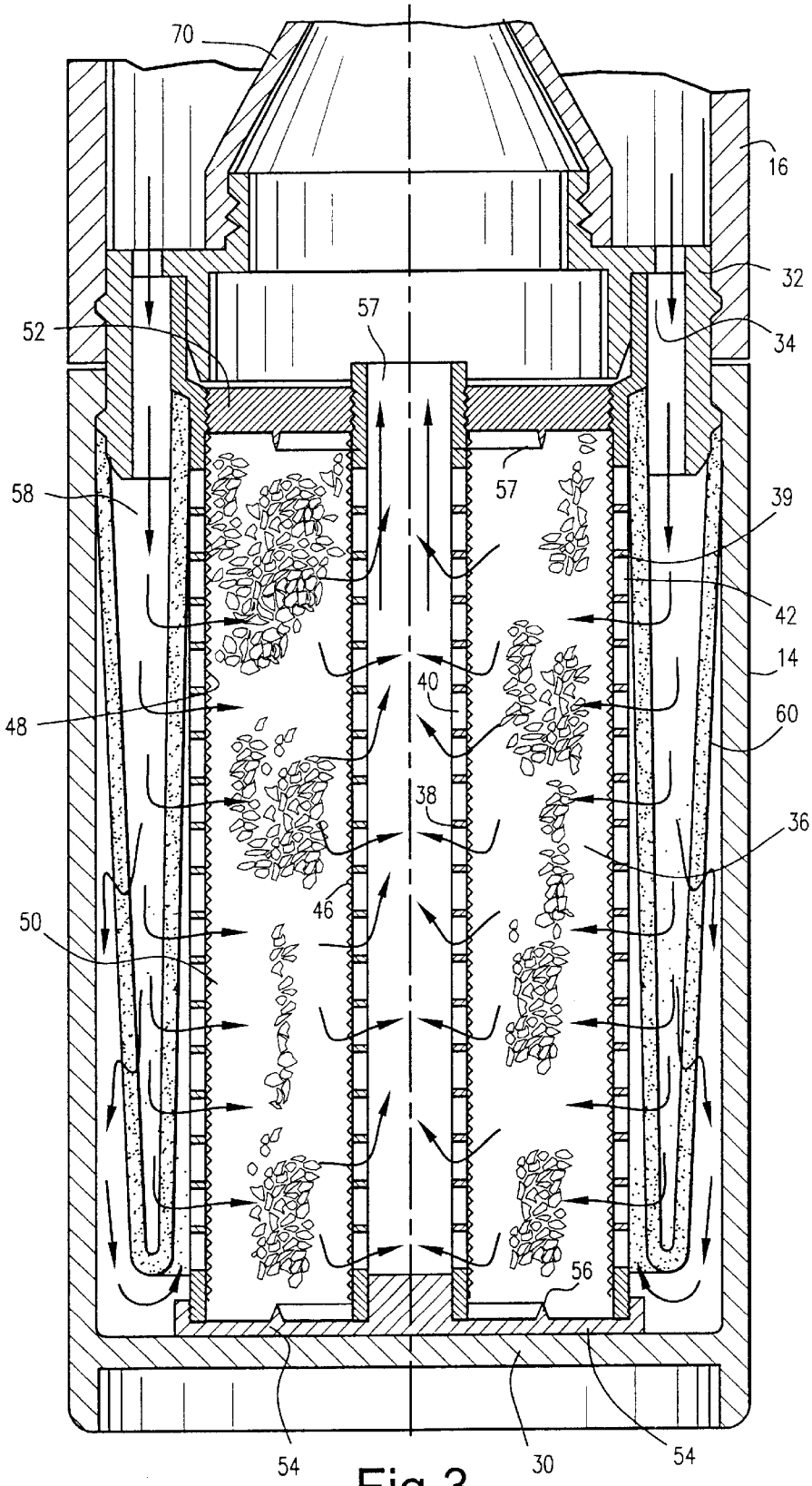
FIG. 3 is a fragmentary enlarged cross-sectional view of the breathing system hereof through the canister when the mouthpiece and hood are deployed.

Referring now to FIG. 3, the canister body 14 is generally cylindrical and preferably closed at its lower end. An interior ring 32 having external interrupted threads secures the intermediate ring 16 and the body 14 one to the other. The interior ring 32 has a plurality of circumferentially spaced openings 34 for admitting ambient air into the canister, as explained below.

A filtration unit 36 in the form of an annulus is disposed within the body 14. The filtration unit 36 is elongated in an axial direction and has inner and outer walls 38 and 39, respectively, spaced radially from one another. The inner and outer walls 38 and 39, respectively, of the filtration unit 36 have a plurality of apertures 40 and 42, respectively, through which air is passed in a generally radial direction. The apertures are preferably rectilinear-shaped slots to maximize air passage and to minimize pressure drop. The interior surfaces of the inner and outer walls 38 and 39, respectively, are provided with linings 46 and 48, respectively, formed of a flexible porous material. Within the lining and filling the annulus between the inner and outer walls of the filtration unit is particulate filtering material 50. The material 50 may, for example, comprise activated charcoal particles. An annular ring 52. is threaded between the inner and outer walls at the upper end of the filtration unit 36 to maintain the particulate material in the filtration unit annulus. The lower end of the filtration unit includes a cap 54 which is screwthreaded onto the lower end of the filtration unit. In a preferred embodiment, the cap 54 along its inner surface may include an upwardly projecting annular rib 56. An annular rib 57 also projects downwardly into the filtration material from the annular ring 52 at the upper end of the filtration unit. Ribs 56 and 57 preclude channeling or bypass of the air as the air flows radially inwardly to the central passage.

As illustrated in FIG. 3, the inner wall 38 of the annular filtration unit 36 comprises a central passageway 57 which receives filtered air flowing radially inwardly through the outer and inner walls 39 and 38, respectively, the liners 46 and 48 and the particulate material 50 of the filtration unit for flow axially into the mouthpiece 22.

From a review of FIG. 3, it will be appreciated that the outer walls 39 of the filtration unit 36 are radially spaced from the interior surfaces of the canister defining an annular passageway 58 in communication with the ambient air inlets 34. An annular flexible filter 60 is received within the annular space between the canister wall and the outer wall of the filtration unit. The annular filter 60 may comprise a HEPA filter having 99.97 efficiency down to 0.3 microns or an N95 filter having 95% efficiency down to 0.5 microns or any type of similar filter suitable to a particular application. The filter 60 is formed of a flexible material open at an annular upper end and closed at its lower end, forming an annular envelope for receiving the ambient air from inlet apertures 34. The upper margins of the annular filter 60 may be secured between the interior ring 32 and the outer wall of the canister and between the interior of the securing ring and the filtration unit. Thus, ambient air flowing into the annular passageway 58 between the filtration unit outer wall and the canister wall first passes through the envelope formed by the annular filter 60.

Figure 4:
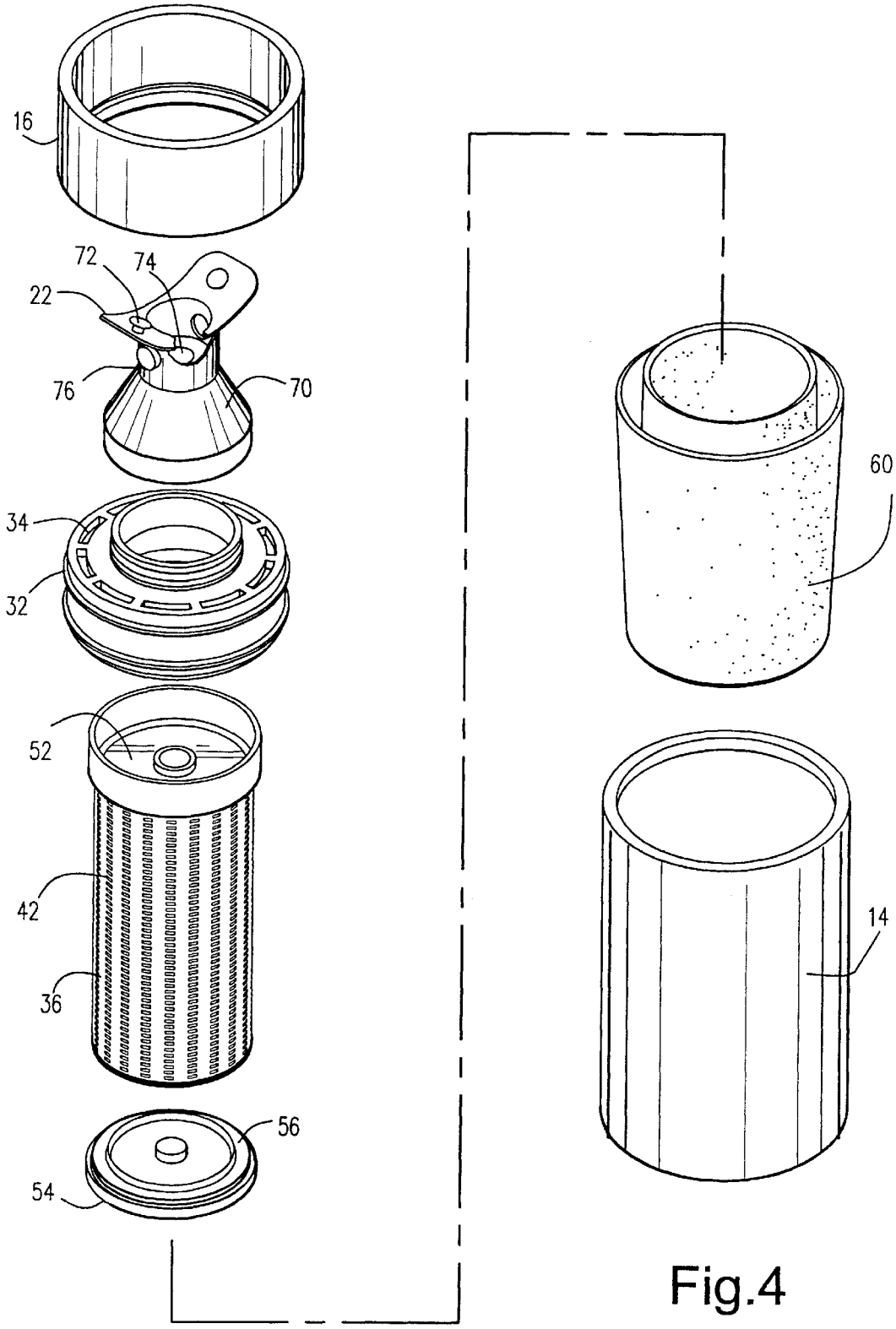
FIG. 4 is a perspective view of various component parts forming the present system.
Figure 5:
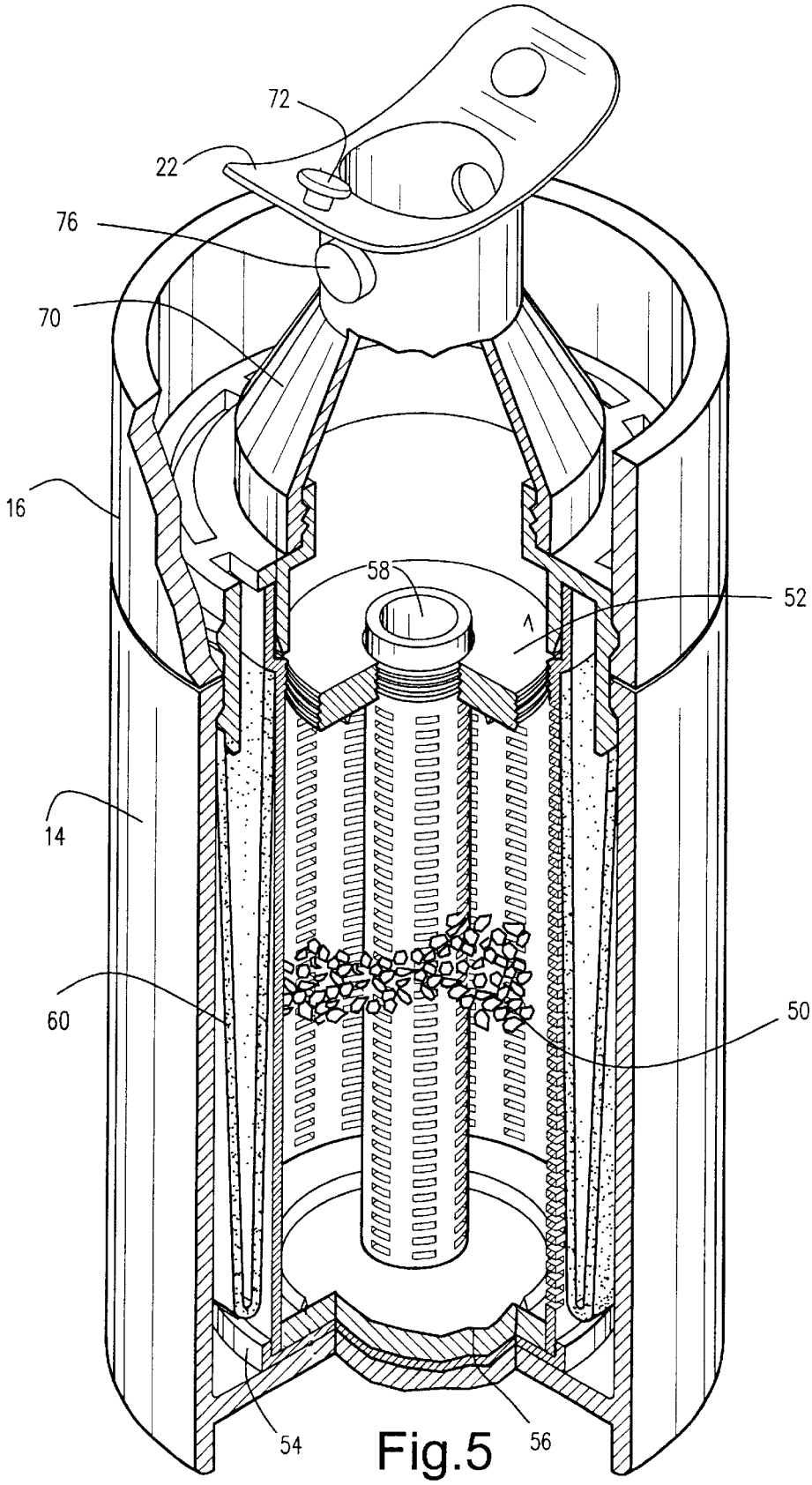
FIG. 5 is an enlarged cross-sectional view of the canister with parts broken out and in cross-section for ease of illustration.

Referring to FIGS. 3 and 4, the mouthpiece 22 forms part of a plenum 70 connected at a large diameter end to the interior ring 32 and in communication with the central passage 57 for receiving the filtered air. The mouthpiece 22 includes bite wings 72 for gripping the mouthpiece between the individual's teeth and inhalation and exhalation check valves 74 and 76, respectively, adjacent the smaller diameter end of the plenum 70.

To use the system hereof, it will be appreciated that the filtration unit, mouthpiece and hood are stored within the canister, with the closure secured to the canister whereby the canister is effectively sealed and ready for use. The hood and mouthpiece are collapsed in this stored condition within the canister and between the filtration unit and the closure. Upon recognition that an individual requires an emergency breathing system, for example, should the individual be in a smoke-filled or toxic gas environment, the individual removes the closure 18, enabling the hood 20 and the mouthpiece 22 to be deployed from the canister. The individual then places the hood 20 over his/her head and tightens the closing means, e.g., drawstring 26, about the neck to form an imperfect but comfortable seal. The individual grasps the mouthpiece in his/her mouth by biting down on the bite wings and applies the nose clips to his/her nose. It will be appreciated that by removing the closure 18, the inlet openings 34 are exposed to the ambient air, including the smoke and toxic gases.

Upon inspiration, the ambient toxic gas and/or smoke-filled air flows through the annular filter 60 for a first filtering and then flows radially inwardly from the annular space between the canister wall and the outer wall 39 of the air filtration unit, through the apertures 42, outer filter liner 48 and particulate filtering material 50. The air continues to flow radially through the interior filter liner 46 and the apertures 40 along the interior wall 38 of the filtration unit 36 until the filtered air flows into the central passageway 57. The filtered air then changes direction and flows axially along passageway 57 into the plenum 70, through the one-way inhalation check valve 74 such that the individual may breathe filtered air. Upon exhalation through the individual's mouth, the inlet check valve 74 closes, preventing exhaled air from returning to the filtration unit 36, while the exhalation check valves 72 open, enabling the exhaled air to flow from the mouthpiece into the interior of the hood 20 about the individual's head. Since the exhaled air will create an over-pressure condition within the hood 20, the exhaled air leaks past the imperfect/comfortable seal formed by the opening in the hood about the individual's neck.

Note that a pair of filters generally in annular shape, i.e., the annular filter 60 and the annular filtration unit 36 are utilized. Note also that an increase in the mass of filtering particulate mass combined with a significant increase in effective surface area is achieved, with a resulting decrease in pressure drop by employing a radial flow system as compared with straight axial flow filtering elements as in the two prior patents noted above. This is highly beneficial, as it facilitates breathing by the individual, while simultaneously affording necessary filtered air.

Figure 6:
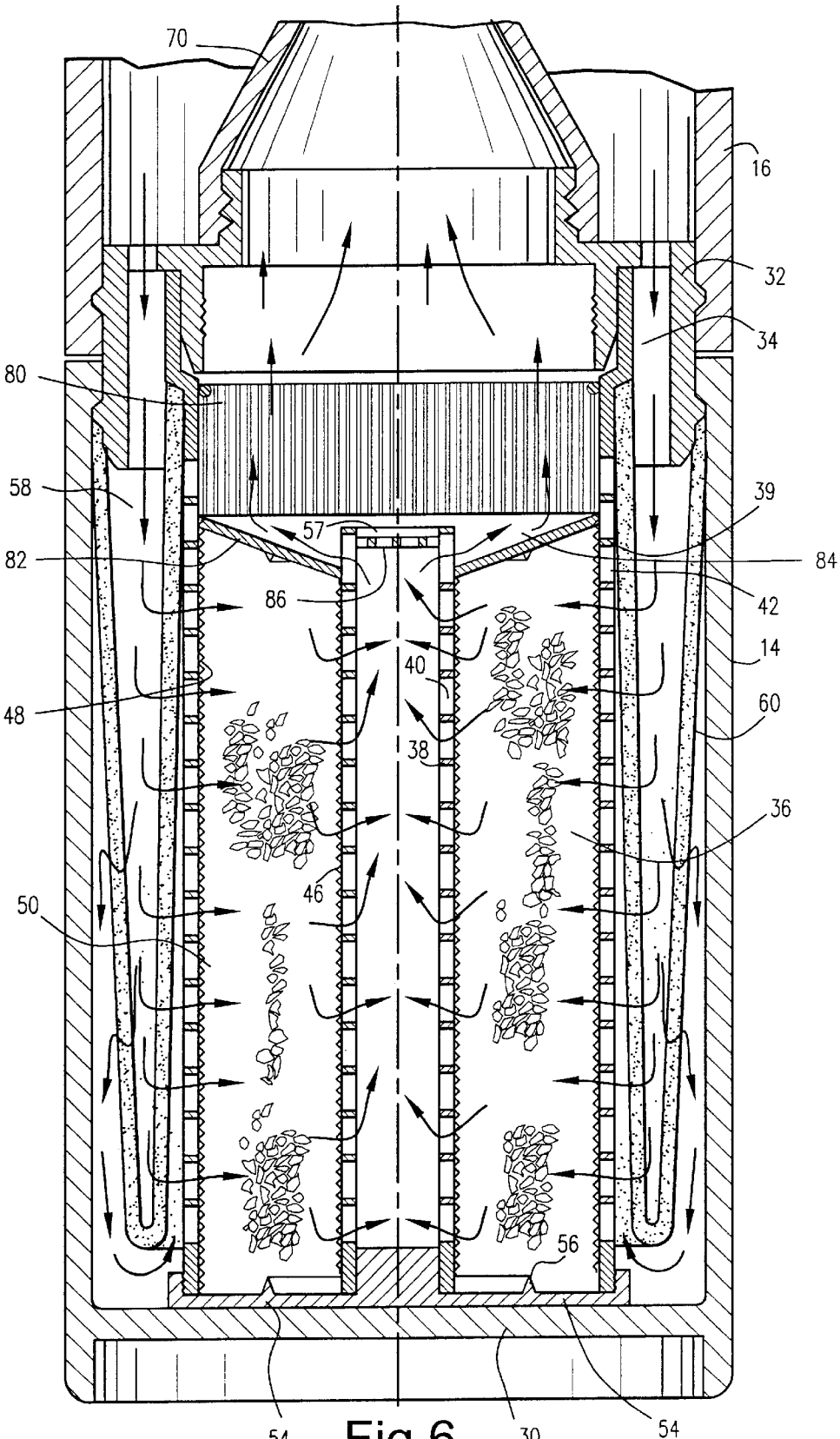
FIG. 6 is a view similar to FIG. 3 illustrating an annular filtration unit in combination with a monolithic filter within the canister.

Referring now to FIG. 6, like reference numerals are applied to like parts as in the prior embodiment. Here, however, separate axial flow filter 80 may be provided above the air filtration unit 36 in communication with the central passageway 58. The filter comprises a monolithic filter 80 for converting carbon monoxide to carbon dioxide by a catalyzation process. The axial flow filter 80 comprises a monolith filter in the form of a disk disposed above the filtration unit 36. Preferably, the cap 82 at the upper end of the filtration unit 36 is funnel-shaped to define with the lower end of the disk-shaped monolith filter 80 a plenum 84. The upper end of the central tube defining the axial passage through the filtration unit 36 terminates short of the lower face of the monolith filter disk 80 and in a further filter screening element 86. In the preferred embodiment, the filter element 80 is maintained within the filtration unit by a friction fit, including an O-ring 88 between the outer margin of the filter 80 and the interior wall of the filtration unit. As a consequence of this construction, the filtered air from the initial filtration unit 36 flows into plenum 84 where it passes axially through the monolithic filter, converting carbon monoxide to carbon dioxide by a catalyzation process. This design provides a unit which will protect against NBC gases and fire gases including CO. There may also be a further stage in the axial flow passageway 58, for example, a lithium peroxide filter for converting carbon dioxide to oxygen.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A personal emergency breathing system comprising:

a canister having an opening and a closure removably carried by said canister for closing said opening;

a generally annular air filtration unit within said canister containing air filtering material and defining with said canister an annular passage about said filtration unit for receiving ambient air from an air inlet to said canister, said filtration unit having an axially extending central passageway and inner and outer walls with apertures enabling transmission of ambient air in a generally radial direction from the annular passageway through the walls and filtering material and into the central passageway;

an annular filter in said annular passage in communication with said air inlet for receiving and filtering ambient air for flow into said annular passage;

a mouthpiece carried by said canister in communication with said central passageway for receiving filtered air from said central passageway and deployable from said canister;

a hood carried by said canister enveloping said mouthpiece and deployable from said canister, said hood having an opening for receiving an individual's head and neck whereby the hood, when deployed from said canister, may envelop an individual's head, said mouthpiece and said hood being disposed in a collapsed condition in said canister adjacent said canister opening and between said filtration unit and said closure whereby, upon removal of said closure from said opening, said hood and said mouthpiece are deployable from said canister through said canister opening to a location external to said canister, with said mouthpiece in communication with and receiving filtered air from the filtration unit.

2. A system according to claim 1 wherein said air inlet lies in communication with said canister opening for receiving ambient air upon removal of the closure.

3. A system according to claim 2 wherein said annular filter in said annular passage includes inner and outer wall portions formed of filtration material, said inner and outer wall portions defining an opening at one end of said filter for communication with said air inlet and said annular filter being closed at an opposite end thereof, enabling flow of ambient air from said air inlet into said filter between said wall portions for flow into said annular passage.

4. A system according to claim 1 wherein said air filtration unit includes a closure cap at one end thereof, said cap having resilient material along an inside face thereof for maintaining said filtering material within said filtration unit in a compressed condition.

5. A system according to claim 1 wherein said air filtration unit includes porous liners comprising a filtering medium on inside surfaces of said inner and outer walls and confining the filtering material within said annular filtration unit.

6. A system according to claim 1 wherein said filtering material includes activated charcoal said annular filtration unit having closures at opposite ends with at least one closure having a rib protecting in an axial direction into the filtering material to preclude or minimize bypass of the filtering material by the air flowing into the central passageway.

7. A system according to claim 1 wherein said filtering material includes a catalyst for catalyzation of CO to $CO_2$.

8. A system according to claim 1 including a plenum between said mouthpiece and said filtration unit, first and second check valves disposed in said plenum, said first check valve enabling flow of filtered air from said filtration unit into said mouthpiece and preventing backflow of exhaled air into said filtration unit, said second check valve enabling air exhaled into said mouthpiece to flow into said hood and preventing backflow of air from said hood through said second check valve into said plenum.

9. A personal emergency breathing system comprising:

a canister having an opening and a closure removably carried by said canister for closing said opening;

a generally annular air filtration unit within said canister containing air filtering material and defining with said canister an annular passage about said filtration unit for receiving ambient air from an air inlet to said canister, said filtration unit having an axially extending central passageway and inner and outer walls with apertures enabling transmission of ambient air in a generally radial direction from the annular passageway through the walls and filtering material and into the central passageway;

a mouthpiece carried by said canister in communication with said central passageway for receiving filtered air from said central passageway and deployable from said canister;

a hood carried by said canister enveloping said mouthpiece and deployable from said canister, said hood having an opening for receiving an individual's head and neck whereby the hood, when deployed from said canister, may envelop an individual's head, said mouthpiece and said hood being disposed in a collapsed condition in said canister adjacent said canister opening and between said filtration unit and said closure whereby, upon removal of said closure from said opening, said hood and said mouthpiece are deployable from said canister through said canister opening to a location external to said canister, with said mouthpiece in communication with and receiving filtered air from the filtration unit;

an annular filter in said annular passage in communication with said air inlet for receiving and filtering ambient air for flow into said annular passage:

said air inlet lying in communication with said canister opening for receiving ambient air upon removal of the closure;

said annular filter including inner and outer wall portions formed of filtration material, said inner and outer wall portions being open at one end of said filter for communication with said air inlet and closed at an opposite end of the filter, enabling flow of ambient air from said air inlet into said filter between said wall portions for flow into said annular passage; and a mounting ring adjacent said opening having at least one aperture for receiving ambient air from said canister opening and passing the ambient air into said annular filter through said open one end thereof, said filter being secured in said canister by said ring.

10. A personal emergency breathing system comprising:

a canister having an opening and a closure removably carried by said canister for closing said opening;

a generally annular air filtration unit within said canister containing air filtering material and defining with said canister an annular passage about said filtration unit for receiving ambient air from an air inlet to said canister, said filtration unit having an axially extending central passageway and inner and outer walls with apertures enabling transmission of ambient air in a generally radial direction from the annular passageway through the walls and filtering material and into the central passageway;

a mouthpiece carried by said canister in communication with said central passageway for receiving filtered air from said central passageway and deployable from said canister;

a hood carried by said canister enveloping said mouthpiece and deployable from said canister, said hood having an opening for receiving an individual's head and neck whereby the hood, when deployed from said canister, may envelop an individual's head, said mouthpiece and said hood being disposed in a collapsed condition in said canister adjacent said canister opening and between said filtration unit and said closure whereby, upon removal of said closure from said opening, said hood and said mouthpiece are deployable from said canister through said canister opening to a location external to said canister, with said mouthpiece in communication with and receiving filtered air from the filtration unit; and a second annular filtration unit within said canister, said second unit being disposed between said filtration unit and said mouthpiece for receiving filtered air from the central passageway.

11. A personal emergency breathing system comprising:

a canister having an opening and a closure removably carried by said canister for closing said opening;

a generally annular air filtration unit within said canister containing air filtering material and defining with said canister an annular passage about said filtration unit for receiving ambient air from an air inlet to said canister, said filtration unit having an axially extending central passageway and inner and outer walls with apertures enabling transmission of ambient air in a generally radial direction from the annular passageway through the walls and filtering material and into the central passageway;

a plenum in said canister for receiving the filtered air from said central passageway;

a secondary filter for receiving the filtered air from said plenum and further filtering the air;

a mouthpiece carried by said canister in communication with said secondary passageway for receiving the further filtered air and deployable from said canister;

a hood carried by said canister enveloping said mouthpiece and deployable from said canister, said hood having an opening for receiving an individual's head and neck whereby the hood, when deployed from said canister, may envelop an individual's head, said mouthpiece and said hood being disposed in a collapsed condition in said canister adjacent said canister opening and between said filtration unit and said closure whereby, upon removal of said closure from said opening, said hood and said mouthpiece are deployable from said canister through said canister opening to a location external to said canister, with said mouthpiece in communication with and receiving the further filtered air.

12. A system according to claim 11 including an annular filter in said annular passage in communication with said air inlet for receiving and filtering ambient air for flow into said annular passage.

13. A system according to claim 12 wherein said air inlet lies in communication with said canister opening for receiving ambient air upon removal of the closure.

14. A system according to claim 13 wherein said annular filter includes inner and outer wall portions formed of filtration material, said inner and outer wall portions being open at one end of said filter for communication with said air inlet and closed at an opposite end of the filter, enabling flow of ambient air from said air inlet into said filter between said wall portions for flow into said annular passage.

15. A system according to claim 14 including a mounting ring adjacent said opening having at least one aperture for receiving ambient air from said canister opening and passing the ambient air into said annular filter through said open one end thereof, said filter being secured in said canister by said ring.

16. A system according to claim 11 wherein said air filtration unit includes a closure cap at one end thereof, said cap having resilient material along an inside face thereof for maintaining said filtered material within said filtration unit in a compressed condition.

17. A system according to claim 11 wherein said air filtration unit includes porous liners comprising a fines filtering medium on inside surfaces of said inner and outer walls and confining the filtering material within said annular filtration unit.

18. A system according to claim 11 wherein said secondary filter includes a catalyst for catalyzation of CO to $CO_2$.

19. A system according to claim 11 including a second plenum between said mouthpiece and said secondary filter, first and second check valves disposed in said plenum, said first check valve enabling flow of the further filtered air into said mouthpiece and preventing backflow of exhaled air into said secondary filter, said second check valve enabling air exhaled into said mouthpiece for flow into said hood and preventing backflow of air from said hood through said second check valve into said second plenum.

* * * * *